United States Patent [19]

Martin, Jr. et al.

[11] 4,143,498

[45] Mar. 13, 1979

[54] CONCEALED FASTENER CLIP FOR BUILDING PANELS

[75] Inventors: Mulford Martin, Jr.; Donald W. Richter, both of Middletown, Ohio

[73] Assignee: Armco Steel Corporation, Middletown, Ohio

[21] Appl. No.: 815,505

[22] Filed: Jul. 14, 1977

[51] Int. Cl.[2] ..... E04C 1/10; E04B 2/32

[52] U.S. Cl. ..... 52/489; 52/584; 52/588; 52/595

[58] Field of Search ..... 52/489, 512, 584, 588, 52/595

[56] References Cited

U.S. PATENT DOCUMENTS

| | | | |
|---|---|---|---|
| 2,333,999 | 11/1943 | Guignon | 52/489 |
| 3,300,934 | 1/1967 | Waizenhofer | 52/489 X |
| 3,312,028 | 4/1967 | Schroyer | 52/588 |
| 3,394,519 | 7/1968 | Tischuk | 52/489 X |
| 3,511,011 | 5/1970 | Straus | 52/489 |
| 3,557,509 | 1/1971 | Blaski | 52/489 |
| 3,577,694 | 5/1971 | Omholt | 52/489 X |
| 3,777,430 | 12/1973 | Tischuk | 52/595 |
| 3,916,577 | 11/1975 | Vare | 52/489 |
| 3,922,764 | 12/1975 | Downing | 52/489 X |
| 4,000,596 | 1/1977 | Magill et al. | 52/489 X |
| 4,028,859 | 6/1977 | Bellagamba | 52/489 |

FOREIGN PATENT DOCUMENTS

| | | | |
|---|---|---|---|
| 638660 | 3/1962 | Canada | 52/489 |

*Primary Examiner*—J. Karl Bell

*Attorney, Agent, or Firm*—Melville, Strasser, Foster & Hoffman

[57] ABSTRACT

A concealed fastener clip for attaching a plurality of panels disposed in an edge-to-edge relationship to a support frame. The concealed fastener comprises a body portion of generally C-shaped cross section which generally follows the annular space between edges of adjacent panels. One edge of the body portion of the fastener comprises a standoff leg terminating in a lateral flange, and means are provided to secure the lateral flange to the support frame when the fastener is sandwiched between abutting panels.

8 Claims, 15 Drawing Figures

CONCEALED FASTENER CLIP FOR BUILDING PANELS

BACKGROUND OF THE INVENTION

1. Field of the Invention

This invention relates to building construction and generally to the joining of modular panels to form a continuous wall, and more particularly to fasteners for joining such panels to a support frame.

2. Description of the Prior Art

In the use of conventional panels for erecting buildings and the like, difficulty has been experienced in obtaining a satisfactory interlocking joint connecting adjacent panels in generally edge-to-edge relationship and in obtaining satisfactory fasteners for securing such panels to a support frame.

While many prior art fastener expedients for attaching a plurality of panels disposed in the edge-to-edge relationship to a support frame have proven to be satisfactory in some respects, they have generally proven to be unsatisfactory, in that they have not been concealed, they generally require modification of panels for their use, they do not provide a positive restraint of outer panel skin, and they cannot easily be installed by unskilled labor.

Accordingly, the building industry is seeking a concealed fastener for attaching a plurality of panels disposed in edge-to-edge relationship to a support frame which will not require modification of the panels for its use, which will provide positive restraint of outer panel skin and which may be easily installed by unskilled labor.

SUMMARY OF THE INVENTION

The present invention provides a concealed fastener clip for attaching a plurality of panels disposed in edge-to-edge relationship to a support frame. In general, each panel comprises an outer metal skin and an inner metal skin separated by and joined to an intermediate insulating core substantially filling the space between the skins. One edge of each panel is provided with a recessed groove of generally U-shaped cross section, the end portions of the inner and outer skins at this edge being bent and offset inwardly and engaging an edge portion of the insulating core to form a female member. The other edge of each panel is provided with an edge portion of reduced thickness (tongue), the end portions of the inner and outer skins at the other edge being bent and offset inwardly and engaging an edge portion of the insulating core to form a male member. The panels are joined in edge-to-edge relationship with the male edge of one panel being received by the female edge of an adjacent panel to form interlocking and telescoping joints therebetween. At least one concealed fastener clip secures adjacent panels to the support frame. The concealed fastener clip comprises a central portion of generally C-shaped cross section which generally follows the annular space between the male and female edges of engaged panels. The trailing edge of the clip has a standoff leg terminating in a lateral flange. Each clip is sandwiched in between the male and female edges of adjacent panels and means are provided to secure the lateral flange of the clip to the support frame. When the panels are in lateral engagement they are secured to the support frame, the male edge of one panel being held within the female edge of an adjacent panel and the female edge of the adjacent panel being held by the arcuate hook portion of the fastener.

The concealed fastener clips are hidden from the outside of the construction by the panels as well as from the inside by the supporting frame.

In a preferred embodiment the concealed fastener clips may be reinforced by impressions parallel to the cross section thereof. This prevents the uncurling of a fastener under load. Additionally, reinforcing fillets may be provided at the bends to prevent straightening of the clip.

An aperture may be provided in the lateral flange portion of the fastener and the means to secure the lateral flange to the support frame may comprise a bolt or a self-drilling screw.

In a preferred embodiment the central portion of the fastener is circular in cross section and the radius thereof is constant. This allows easy installation of the fastener.

In still a further preferred embodiment, the recessed groove of the female edge of each panel is formed by the insulating core and end portions of the outer and inner skins and each end portion is provided with a return element bent and offset inwardly in parallel spaced relation to its respective skin and engaging an edge portion of the panel insulating core. The leading edge of the fastener is sharpened in order to cut its own path into the insulation core at the female edge of the panel between the return element and the skin.

In yet a further embodiment, the leading edge of the fastener is provided with an offset so that it is substantially coplanar with the return element of the outer skin, the offset substantially coinciding with the thickness of the outer skin.

Finally, in a further embodiment the recessed groove of the female edge of each panel is formed by the insulating core and end portions of the outer and inner skins and each end portion is provided with a return element bent and offset inwardly in parallel spaced relation to the respective skin and engaging an edge portion of the panel insulating core. The leading edge of the fastener is sandwiched between the return element of the outer skin of the female edge of a panel and the edge portion of the outer skin at the male edge of an adjacent panel.

DESCRIPTION OF THE PREFERRED EMBODIMENTS

Figure 1:
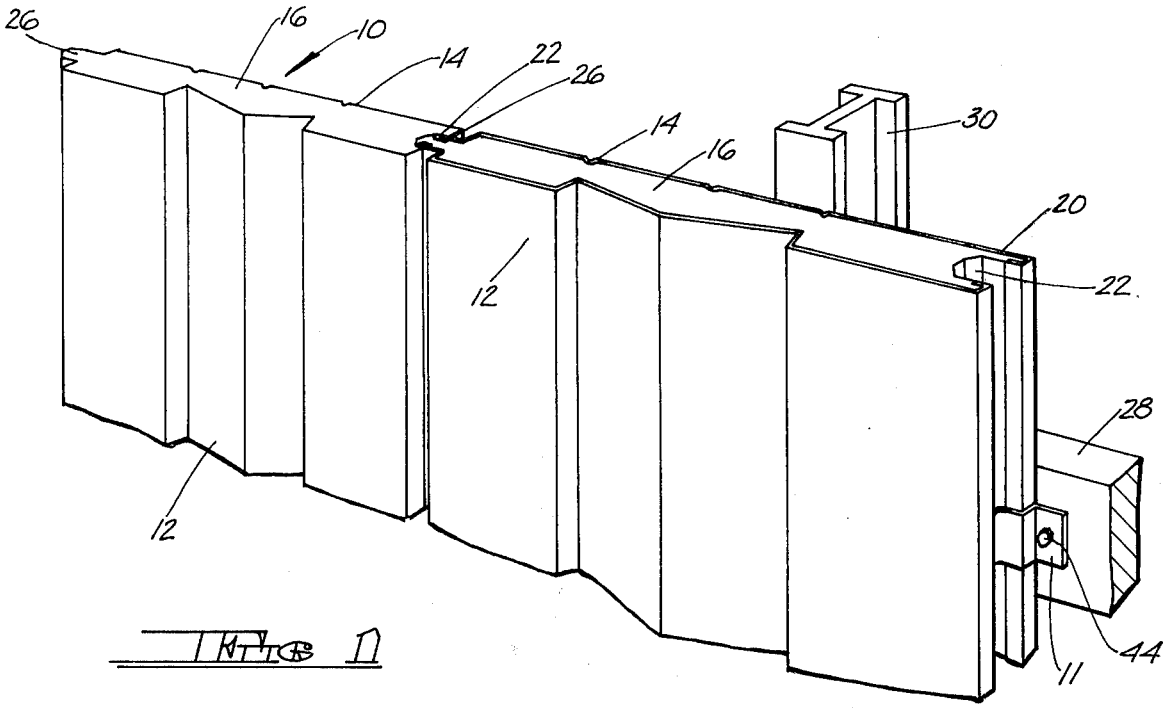
FIG. 1 is a fragmentary perspective view showing a plurality of building panels disposed in edge-to-edge relationship and attached to a support frame by the concealed fastener clip of the present invention.

Referring now to the drawings, and, more particularly, to FIG. 1, a plurality of panels 10 with which the concealed fastener clips 11 of the present invention may be used, are disposed in edge-to-edge relationship. Each panel 10 comprises an outer metal skin 12 and an inner metal skin 14 separated by and joined to an insulating core 16 substantially filling the space between the skins 12 and 14.

In practice, the insulating core 16 is formed of any suitable insulating material, such as material which is light weight, fibrous or particulate aggregate held together by a binder. However, it has been found that best results are obtained when the core comprises a material characterized as integral, low density, cellular material having uniform small voids, such as, for example, urethane or polystyrene, which may be pressure expanded in situ.

Figure 3:
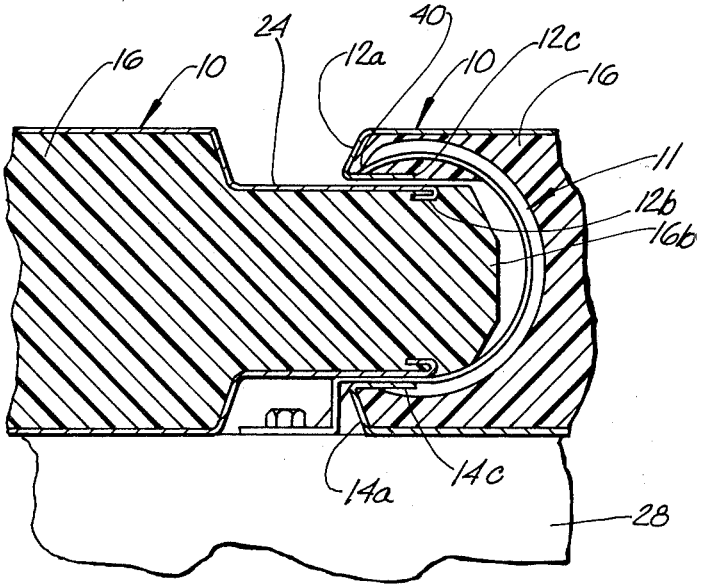
FIG. 3 is an enlarged, fragmentary view showing the interlocking male and female edges of adjacent panels and a concealed fastener clip of the present invention as shown in FIGS. 4 through 6.

The female edge 20 of each panel 10 is provided with a recessed groove 22 of generally U-shaped cross section. The recessed groove 22 may be formed by edge portions 12*a*, 14*a* of the outer and inner skins 12 and 14, respectively, having return elements 12*c* and 14*c* in a parallel spaced relation to the outer and inner skins 12 and 14, respectively, and by an edge portion of the insulating core 16, as best seen in FIG. 3, or, of course, the edge portions 12*a*, 14*a* of the outer and inner skins 12 and 14, respectively, may extend in the recessed groove 22 until they meet. Additionally, if desirable, an edge closure member may be used in the recessed groove 22.

The male edge 24 of each panel 10 is provided with a tongue portion 26 of reduced thickness where the edge portions 12*b* and 14*b* of the outer and inner skins 12 and 14, respectively, are bent and offset inwardly and engage an edge portion 16*b* of the insulation body or core element 16 to form a male member. The tongue portion 26 of the panel edge portion of reduced thickness may be formed by an end portion 12*b*, 14*b* of the outer and inner skins 12 and 14, respectively, or by an edge portion 16*b* of the insulating core 16.

Figure 2:
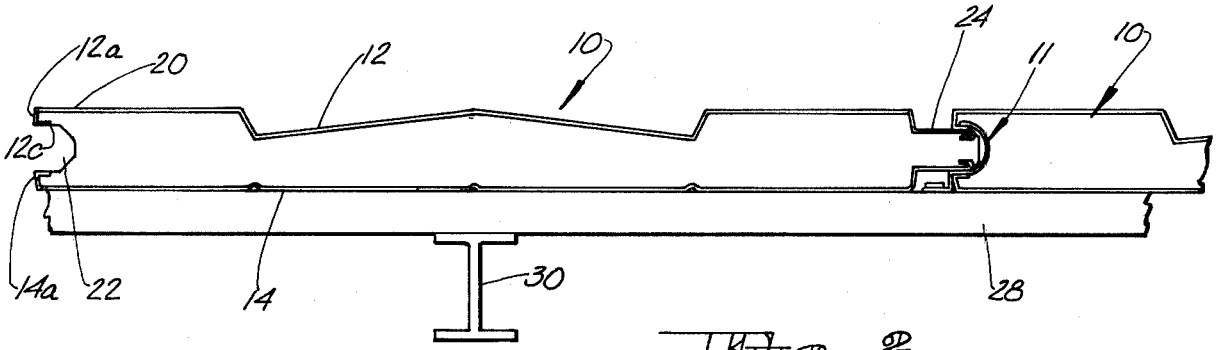
FIG. 2 is a plan view of two building panels disposed in edge-to-edge relationship and secured to a support frame by the concealed fastener clip of the present invention.

A building construction comprising a plurality of panels 10 disposed in edge-to-edge relationship is shown in FIGS. 1 and 2. Each panel 10 is of a width and of a length which is determined by the requirements of the building and the location of the support frame 28, which includes the columns 30.

As can be seen, the recessed groove 22 on the edge 20 of one panel 10 forms a female member into which the tongue portion 26 on the male edge 24 of an adjoining panel 10 may project to form an interlocking and telescoping joint therebetween.

Figure 4:
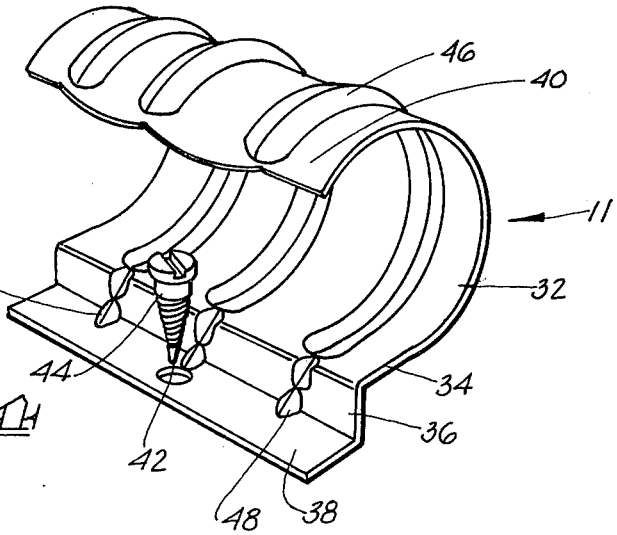
FIG. 4 is a perspective view of a concealed fastener clip of the present invention.
Figure 5:
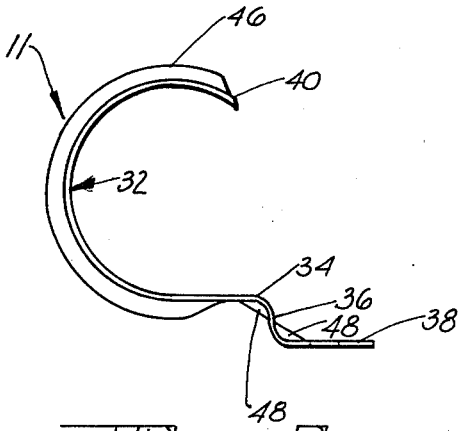
FIG. 5 is an end view of the fastener of FIG. 4.
Figure 6:
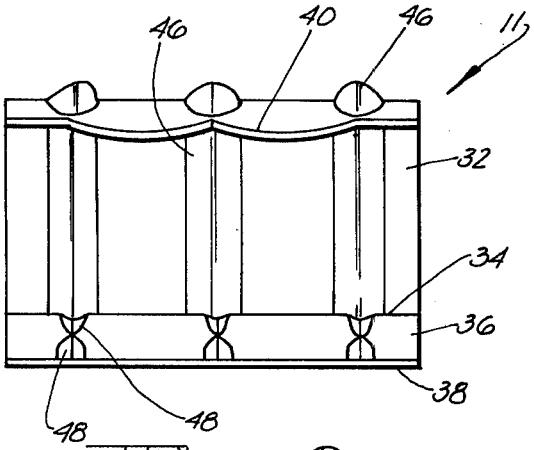
FIG. 6 is a side elevational view of the fastener of FIG. 4.

The present invention provides a concealed fastener clip 11 for joining the panels 10 to a support frame member 28. An embodiment of the concealed fastener clip 11 is seen in FIGS. 4 through 6. The concealed fastener clip 11 comprises a central portion 32 of generally C-shaped cross section which generally follows the annular space between the male and female edges 24 and 20, respectively, of engaged panels 10. The trailing edge 34 of the central portion 32 is provided with a standoff leg 36 terminating in a lateral flange 38. At least one aperture 42 is provided in the lateral flange 38. In practice, the leading edge 40 of the concealed fastener clip 11 is impaled into the insulating core 16 at the female edge 20 of the panel 10 adjacent to and preferably behind the return element 12*c* and rotated until the lateral flange 38 lies against the support frame member 28. Fastening means 44 are provided to secure the lateral flange 38 to a support frame member 28. In this regard, such fastening means 44 may comprise a self-drilling screw or a bolt.

In practice it has been found desirable to reinforce the clip 11 by impressions or reinforcing ribs 46 parallel to the cross section thereof to prevent uncurling of the central portion 32 under load. Reinforcing fillets 48 may also be provided at the bends on the surface of the clip 11 joining the standoff leg 36 with the trailing edge 34 and the lateral flange 38 to prevent straightening of the fastener or clip 11. Additionally, it has been found desirable to form the central portion 32 of the concealed fastener clip 11 into a circular cross section, with the radius thereof being constant, so as to allow easy installation. If the recessed groove 22 of each panel 10 is formed by the insulating core 16 and the edge portions 12*a* and 14*a* of the outer and inner skins 12 and 14, with each edge portion 12*a* and 14*a* having a return element 12*c* and 14*c* bent and offset inwardly in parellel spaced relation to its respective skin 12 and 14 and engaging an edge portion of the insulating core 16, it is further desirable to sharpen the leading edge 40 of the central portion 32 of the concealed fastener clip 11 to enable the fastener 11 to cut its own path into the insulation core 16 at the edge of the panel 10 between the return element 12*c* and the outer skin 12 and to be anchored behind the return element 12*c* of the panel 10, as best seen in FIG. 3.

Figure 7:
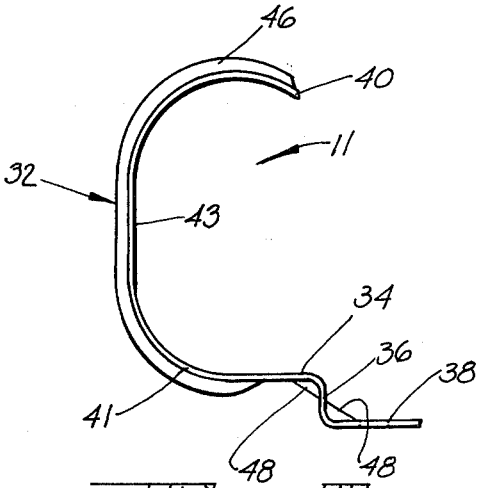
FIG. 7 is an end view of a further embodiment of the fastener of the present invention.
Figure 8:
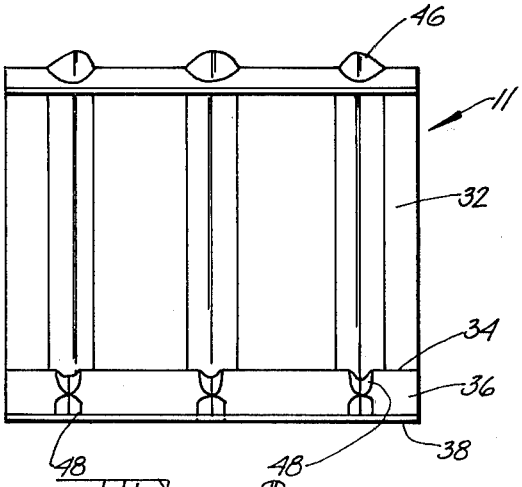
FIG. 8 is a side elevational view of the fastener of FIG. 7.
Figure 9:
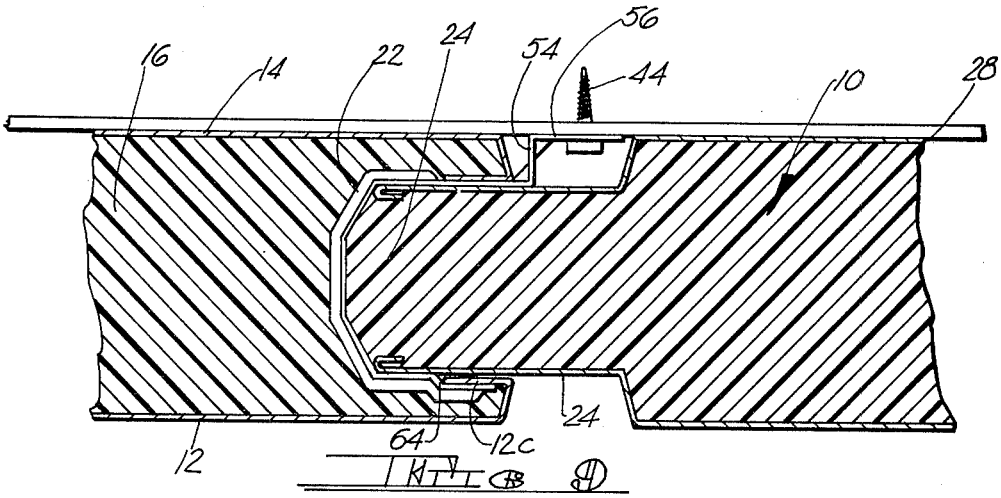
FIG. 9 is an enlarged, fragmentary view showing the interlocking of male and female edges of adjacent panels and a concealed fastener clip of the present invention as shown in FIGS. 10 through 12.
Figure 10:
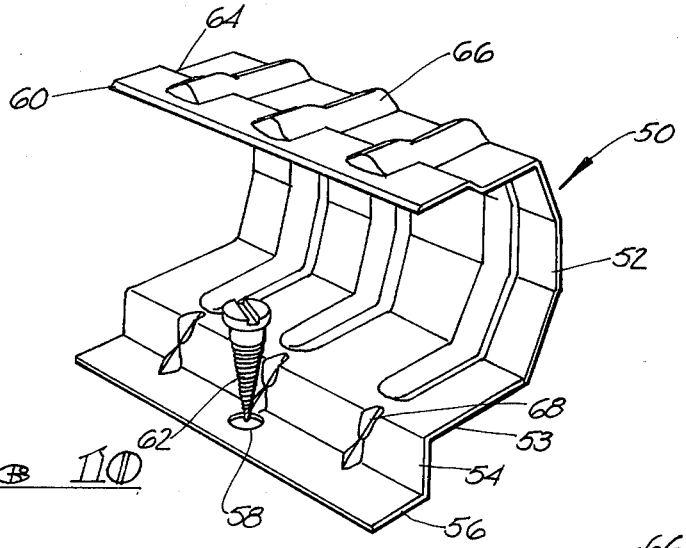
FIG. 10 is a perspective view of yet another embodiment of the concealed fastener clip of the present invention.
Figure 11:
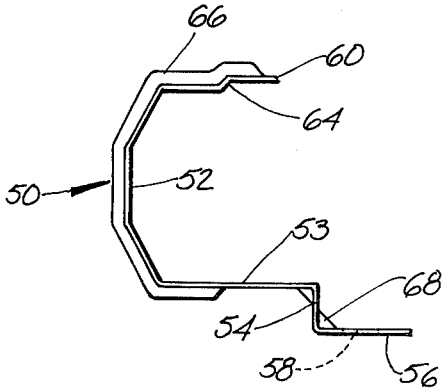
FIG. 11 is an end view of the fastener of FIG. 10.
Figure 12:
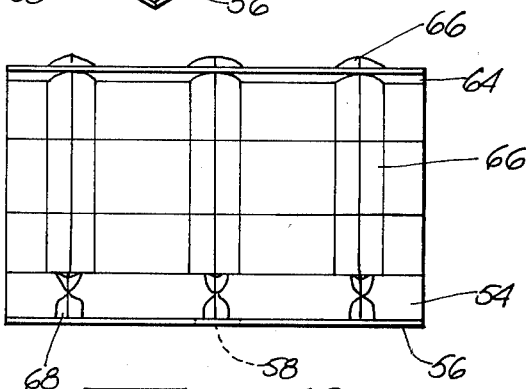
FIG. 12 is a side elevational view of the fastener of FIG. 10.

The fastener 11 shown in FIGS. 4 through 6 is for a two inch thick panel 10, while the fastener 11 as shown in FIGS. 7 and 8 is for a three inch thick panel 10. The difference between the fastener shown in FIGS. 4 through 6 and that in FIGS. 7 and 8 is, of course, in the curvature of the central portion 32. As can be seen, the leading and trailing edges 40 and 41, respectively, of the fastener 11 of FIGS. 7 and 8 are each of circular cross section having a constant radius and joined by a planar straight portion 43.

FIGS. 9 through 12 disclose a further embodiment 50 of the concealed fastener clip 11 of the present invention. While the concealed fastener clip 50 comprises a central portion 52 of generally C-shaped cross section which generally follows the annular space between the male and female edges 24 and 20, respectively, of engaged panels 10, the clip 50 does not have a constant radius. The trailing edge 53 of the clip central portion 52 is provided with a standoff leg 54 terminating in a lateral flange 56. The leading edge 60 of the clip 50 is sharpened so as to cut through the insulation core 16 and to anchor the clip 50 behind the return element 12*c* of the outer skin 12. At least one aperture 58 is provided in the lateral flange 56 to receive fastening means 62, such as a self-drilling screw or bolt. The leading edge 60 of the clip 50 is provided with an offset 64 so that the leading edge 60 is substantially coplanar with the return element 12*c* of the outer skin 12. The offset 64 substantially coincides with the thickness of the return element 12*c* of the outer skin 12.

As will also be seen, the concealed fastener clip 50 may be reinforced by impressions or reinforcing ribs 66 parallel to the cross section thereof to prevent uncurling of the clip 50 under load. Reinforcing fillets 68 may also be provided at the bends on the surface of the clip 50 joining the standoff leg 54 with the trailing edge 53 and the lateral flange 56 to prevent straightening of the clip 50 under load.

Figure 13:
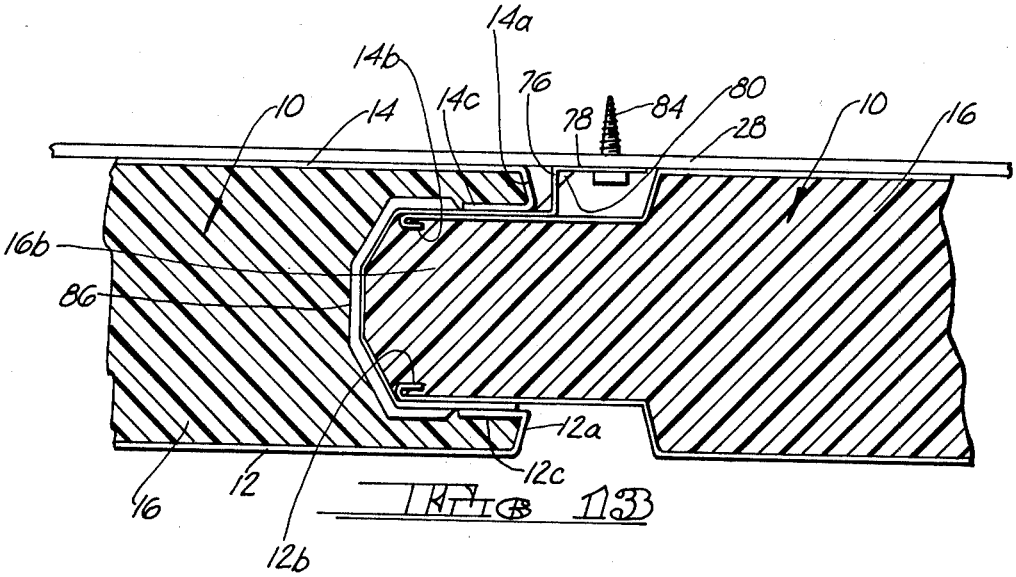
FIG. 13 is an enlarged fragmentary view showing the interlocking of male and female edges of adjacent panels and a concealed fastener clip of the present invention as shown in FIGS. 14 and 15.
Figure 14:
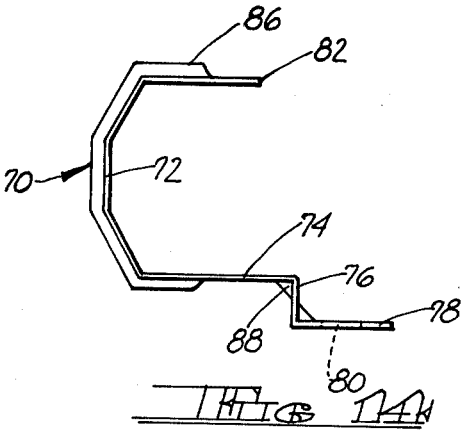
FIG. 14 is an end view of yet a further embodiment of the fastener of the present invention.
Figure 15:
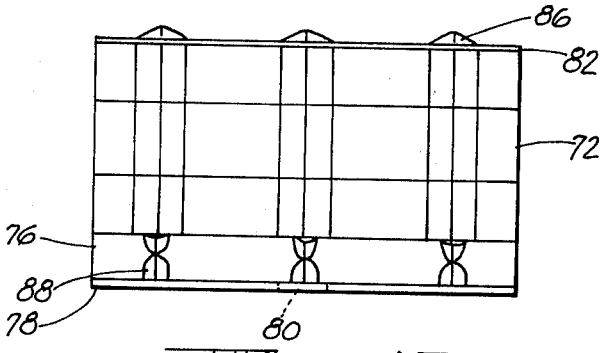
FIG. 15 is a side elevational view of the fastener of FIG. 14.

FIGS. 13 through 15 disclose a further embodiment 70 of the concealed fastener clip 11 of the present invention. While the concealed fastener clip 70 comprises a central portion 72 of generally C-shaped cross section which generally follows the annular space between the male and female edges 24, 20, respectively, of engaged panels 10, the central portion 72 does not have a constant radius. The trailing edge 74 of the central portion 72 is provided with a standoff leg 76 terminating in a lateral flange 78. At least one aperture 80 is provided in the lateral flange 78. The leading edge 82 of the central portion 72 does not have an offset, such as the offset 64 in the clip 50 of FIGS. 9 through 12. Furthermore, the leading edge 82 is not sharpened so that it does not cut through the insulated core 16 when installed, but rather the leading edge 82 is sandwiched between the return element 12*c* and the male tongue portion 26, as best seen in FIG. 13. Fastening means 84 are provided to secure the lateral flange 78 to a support frame member 28. In this regard, the fastening means 84 may comprise a self-drilling screw or a bolt.

As previously indicated in connection with other embodiments of the concealed fastener, it has been found desirable to reinforce the clip 70 by impressions or reinforcing ribs 86 parallel to the cross section thereof to prevent uncurling of the central portion 72 under load. Reinforcing fillets 88 may also be provided at the bends on the surface of the clip 70 joining the standoff leg 76 with the trailing edge 74 and the lateral flange 78 to prevent straightening of the clip 70 under load.

In practice, it has been established that a concealed fastener 11 must withstand a load commensurate with the area of the panels and the force applied to that area without unfolding. In general a safety factor of two is incorporated to that load.

The concealed fastener 11, 50, 70 of the present invention is initially blanked on a flat metal piece. Such a piece includes the reinforcing ribs 46, 66, 86, the reinforcing fillets 48, 68, 88 and the aperture 42, 58, 80. The next operation forms the fastener 11, 50, 70 into generally C-shaped central portion 32, 52, 72 as seen in FIGS. 5, 7, 11 and 14. The clip 11, 50, 70 is engaged in the recessed groove 22 of the female edge 20 and is sandwiched in between the male and female edges 24, 20 of adjoining panels 10. The concealed fastener clip 11, 50, 70 is secured by fastening means 44, 62, 84 such as a bolt or screw through the aperture 42, 58, 80 in the lateral flange 38, 56, 78 to the horizontal building structure support frame member 28 between the columns 30. Since the panels 10 are in lateral engagement, both panels 10 are secured to the structure support frame member 28. The male edge 24 of one panel 10 is held by the female edge 20 of a second panel 10. The female edge 20 is in turn held by the central portion 32, 52, 72 of the fastener 11, 50, 70. The fastener 11, 50, 70 of the present invention is completely hidden from the outer side of the building as well as by the building support frame member 28 on the inside.

The concealed fastener 11, 50, 70 of the present invention holds the joined panels 10 in place and does not interfere with the panel interlock. It is concealed from the outside of the building and as previously indicated, it will withstand a wind load commensurate with the area of the panel it supports, including a safety factor of 2. Use of fastener 11, 50, 70 of the present invention requires no modification of the panels 10 and provides positive restraint of the outer skin 12. The fastener 11, 50, 70 may be simply made by stamping. This provides an efficient use of metal. The fastener 11, 50, 70 is easily installed by unskilled labor, and in most instances a screw-gun is the only required tool. The sharpened leading edge 40, 60 of the fastener 11, 50 cuts the insulation core 16 as the fastener 11, 50 is installed, following its own path.

While certain preferred embodiments of the present invention have been specifically illustrated and described, it is understood that the invention is not limited thereto, as many variations will be apparent to those skilled in the art, and the invention is to be given its broadest interpretation in the terms of the following claims.

We claim:

1. A building construction including a support frame, a plurality of panels disposed in edge-to-edge relationship, each panel comprising an outer metal skin, an inner metal skin and an intermediate insulating core substantially filling the space between said outer and inner metal skins and joined thereto, one edge of each said panel having a recessed groove of generally U-shaped cross section, the end portions of said outer and inner metal skins at the edge of each said panel being bent and offset inwardly and engaging an edge portion of said insulating core to form a female member, said recesses groove being formed by said insulating core and said end portions of said outer and inner metal skins, each said outer and inner metal skin end portions having a return element bent and offset inwardly in parallel spaced relation to its respective skin and engaging an edge portion of said insulating core, and the other edge of said panel having an edge portion of reduced thickness, the end portion of said outer and inner metal skins at the other edge of each said panel being bent and offset inwardly and engaging an edge portion of said insulating body to form a male member, said panels being joined in edge-to-edge relationship with the male member of one panel being received by the female member of an adjacent panel to form interlocking and telescoping joins therebetween, at least one concealed fastener clip to secure adjacent panels to said support frame comprising a central portion of generally C-shaped cross section which generally follows the annular space between said male and female members of engaged panels, said central portion having leading and trailing edge portions of circular cross section and a constant radius, said trailing edge of said central portion having a standoff leg terminating in a lateral flange, each said central portion being sandwiched in between said male and female members of adjacent ones of said panels, the entire leading edge of said clip being sharpened in order to cut its own circular path into said insulating core at said female member edge of said panel between said outer metal skin and said outer metal skin return element, whereby the leading edge of said clip is anchored behind said outer metal skin return element, and fastening means to secure said lateral flange of said clip to said support frame, whereby when said panels are in lateral engagement they are secured to said support frame, the male member of one panel being held to the female member of an adjacent panel and the female member of the adjacent panel being held by said central portion of said clip, said concealed fastener clip being hidden from the outside of said construction by the panels as well as from the inside by the supporting frame.

2. The building construction according to claim 1, wherein said clip is reinforced by impressions parallel to the cross section thereof.

3. The building construction according to claim 1, wherein strengthening and reinforcing ribs are formed in the C-shaped portion of said clip to prevent uncurling of said clip under load.

4. The building construction according to claim 1, wherein reinforcing fillets are provided on the surface of said clip joining said central portion with said standoff leg and said lateral flange to prevent straightening of said clip under load.

5. The building construction according to claim 1, wherein an aperture is provided in said lateral flange of said clip and said fastener means to secure said lateral flange of said clip to said support frame comprises a self-drilling screw.

6. The building construction according to claim 1, wherein an aperture is provided in said lateral flange of said clip, and wherein said fastener means to secure said lateral flange of said clip to said support frame comprises a bolt.

7. The building construction according to claim 1, wherein said leading and trailing edge portions form a clip of circular cross section.

8. The building construction according to claim 1, wherein said leading and trailing edge portions are joined by a planar straight portion.

* * * * *